US008559154B2

(12) United States Patent
Li et al.

(10) Patent No.: US 8,559,154 B2
(45) Date of Patent: Oct. 15, 2013

(54) SYSTEMS AND METHODS FOR SWITCHING A RELAY AT ZERO CROSS

(75) Inventors: Wei Li, Andover, MA (US); Canyon Bliss, Revere, MA (US)

(73) Assignee: OSRAM SYLVANIA Inc., Danvers, MA (US)

( * ) Notice: Subject to any disclaimer, the term of this patent is extended or adjusted under 35 U.S.C. 154(b) by 204 days.

(21) Appl. No.: 13/224,321

(22) Filed: Sep. 1, 2011
(Under 37 CFR 1.47)

(65) Prior Publication Data

US 2013/0057998 A1 Mar. 7, 2013

(51) Int. Cl.
*H01H 47/28* (2006.01)
*H01H 47/32* (2006.01)

(52) U.S. Cl.
USPC ..... 361/187

(58) Field of Classification Search
USPC ..... 361/187
See application file for complete search history.

(56) References Cited

U.S. PATENT DOCUMENTS 4,153,922 A 5/1979 Azuma et al.
5,055,962 A 10/1991 Peterson et al.
5,267,120 A 11/1993 Graff et al.
5,804,991 A * 9/1998 Hu ..... 327/162
5,838,077 A 11/1998 Chelcun et al.
6,233,132 B1 * 5/2001 Jenski ..... 361/160
6,731,080 B2 5/2004 Flory
6,759,954 B1 7/2004 Myron et al.
6,768,615 B2 * 7/2004 Liu ..... 361/2
6,857,858 B2 * 2/2005 Jeun ..... 417/45
6,960,892 B2 11/2005 Loughrey
7,199,531 B2 4/2007 Loughrey
2004/0169987 A1 9/2004 Green
2009/0027824 A1 1/2009 Allen et al.
2011/0080105 A1 4/2011 Mayer et al.

FOREIGN PATENT DOCUMENTS

EP 0 571 122 A1 11/1993

OTHER PUBLICATIONS

Monica Ferla, International Search Report and Written Opinion of the International Searching Authority for PCT/US2012/053509, pp. 1-8, May 6, 2013, European Patent Office, Rijswijk, The Netherlands.

* cited by examiner

*Primary Examiner* — Dharti Patel
(74) *Attorney, Agent, or Firm* — Shaun P. Montana

(57) ABSTRACT

Circuitry, systems and methods that address the need to coordinate relay switching with another event, such as a zero crossing of an alternating current (AC) voltage waveform are described. In some embodiments, the systems and methods continuously or periodically calibrate the timing of control signals to a relay, such that the switching of the relay in response to some (e.g., second or subsequent) control signals occurs closer in time to a zero crossing of an AC line voltage than the switching of the relay in response to other (e.g., initial or first) control signals.

18 Claims, 7 Drawing Sheets

Subsequent Control Signal 508' Sent at time DC' after (D3 – D4) from $ZC_3$

Control Signal 508 Sent at time TC after D3 from $ZC_1$

SYSTEMS AND METHODS FOR SWITCHING A RELAY AT ZERO CROSS

TECHNICAL FIELD

The present invention relates to control circuits, and more specifically, to the control of the switching of a relay circuit in relation to another event, such as the zero crossing of a line voltage.

BACKGROUND

Relays are typically used to switch a variety of electrical loads ON and OFF by connecting and disconnecting the load from a power source, such as a DC power source. For example, a relay may switch an electronic ballast used in lighting applications ON and OFF. Relays may be manually or electronically switched, e.g., in response to a control signal.

When an electrical capacitive load powered by an AC power line is switched ON and OFF with a relay, it is desirable to switch the relay at or near a zero crossing of the AC line voltage to minimize the inrush current. If a relay is switched randomly or at points that are not in close proximity to the zero crossing points of the AC line voltage, the AC voltage may be significant, resulting in the delivery of high inrush current to a downstream electrical load. This high inrush current may damage the contacts of the relay and/or the electrical load, and may decrease the operating lifetime of such components.

SUMMARY

Conventional techniques for addressing the problem of zero-cross switching usually involve heavy duty relays (i.e., relays that can withstand high inrush current), limits on the current load to the electrical load, and/or triodes for alternating current (TRIAC). These solutions are not ideal, and in some cases are expensive. For example, a TRIAC may require high heat dissipation and the use of a potting manufacturing process, and thus can be both expensive and complicated to implement.

In an ideal relay, the relay will instantaneously turn ON and OFF in response to an input, such as a control signal. That is, the turn ON (set) time and turn OFF (reset) time of an ideal relay will equal zero seconds. In real systems employing real relays, however, the set and reset times are non-zero. That is, there is delay between when the relay is instructed to switch (i.e., when the relay receives a control signal) and when relay contact is made or broken. To illustrate this concept, reference is made to FIG. 1, which is a timing diagram showing the delay that occurs when relay contact is made (set), and when relay contact is broken (reset) in response to a control signal. As shown, ON/OFF control signal 100 is switched ON at point 115, but relay contact is not made until point 120. The delay between point 115 and set point 120 is shown as time TON. Since the voltage of AC waveform 105 is not 0 volts at set point 120 (i.e., the voltage is not at a zero crossing point), high inrush current may be delivered to a downstream electrical load if the relay is turned ON at that time. Similarly, ON/OFF control signal 100 is switched OFF at point 125, but relay contact is not broken until reset point 130. The delay between point 125 and reset point 130 is shown as time TOFF. Since the voltage of AC waveform 105 is not 0 volts at reset point 130, a voltage spike may be delivered to a downstream electrical load if the relay is turned OFF at that time. It will be appreciated that FIG. 1 is representative of the operation of a non-toggle relay.

In FIG. 1, ToN and TOFF are depicted as equal, as many relays are known to have equal set and reset times. However, it should be understood that relays having set and reset times that differ from one another are possible. By way of illustration, reference is made to Table 1, which shows the set and reset times of a DSP 1a-L-DC5V toggle relay produced by PANASONIC®.

TABLE 1

| | Sample Type DSP 1a-L-DC5V | |
|---|---|---|
| Sample # | Set Time (ms) | Reset Time (ms) |
| 1 | 3.3 | 2.6 |
| 2 | 3.8 | 3.0 |
| 3 | 3.8 | 2.9 |
| 4 | 3.8 | 2.6 |
| 5 | 3.4 | 3.2 |
| 6 | 3.6 | 2.2 |
| 7 | 3.7 | 2.0 |
| 8 | 3.7 | 2.8 |
| 9 | 3.6 | 2.3 |
| 10 | 3.7 | 2.5 |
| Mean | 3.6 | 2.6 |
| Range | 3.3 to 3.8 | 2.0 to 3.0 |

As shown, the relays in Table 1 exhibit different set and reset times, despite being identically configured. As a result, if a set and/or reset control signal is sent to respective circuit incorporating these relays at identical points in time, the relays may set and/or reset after a slightly different period of time, regardless of whether the relays and circuits are identically configured. In addition to the variability amongst set and reset times of individual relays, the set and reset times of a particular relay may differ over time. For example, the set and/or reset time of a relay may vary with the relay's age, usage history, operating temperature, and other factors. Accordingly, it is often the case that the set and/or reset time of a particular relay is not known precisely. Moreover, even if the set and reset times of a particular relay are known precisely at some point in time, those set and reset times of the relay may change over time. This change can impact the performance of a circuit containing the relay. As a result, even if a circuit incorporating a relay is initially calibrated such that the switching of the relay occurs at a zero crossing of an AC line voltage, the switching of the relay may vary from zero crossing over time. In other words, the initial calibration may go "bad" over time.

In an embodiment, there is provided a system. The system includes: a line status circuit configured to receive a line voltage and output a line status output representative of a first zero crossing $ZC_1$ of the line voltage; a processor circuit configured to output at least one first relay control signal in response to a line status output; a relay coupled to first, second and third line voltage inputs and configured to switch in response to the at least one first relay control signal, thereby coupling or decoupling the second and third line voltage inputs relative to a second zero crossing $ZC_2$ of the line voltage; a relay status circuit configured to output a relay status output representative of a first switching of the relay in response to the at least one first relay control signal; and wherein the processor circuit is further configured to output at least one subsequent relay control signal, so as to trigger a subsequent switching of the relay, relative to at least one subsequent zero crossing $ZC_n$ of the line voltage, and wherein the subsequent switching occurs closer in time to the at least one zero crossing $ZC_n$ than the first switching occurs relative to the second zero crossing $ZC_2$.

In a related embodiment, the system may further include: a trigger circuit configured to output at least one first control pulse and at least one subsequent control pulse to the relay in response to the at least one first relay control signal and the at least one subsequent relay control signal, respectively; wherein the relay may switch in response to the at least one first control pulse and the at least one subsequent control pulse, respectively. In a further related embodiment, the trigger circuit may be a Schmitt trigger.

In another related embodiment, the system may further include a power supply circuit operable to power the line status circuit, processor circuit, relay status circuit, and relay. In yet another related embodiment, the processor circuit may be further configured to output the at least one first relay control signal after a known delay time D3, relative to the first zero crossing, and calculate a calibrated delay from D4 and D3; wherein D3 may be a default delay time of a timer of the processor circuit, and D4 may equal $t_2-t_1$, and $t_1$ may be a moment in time correlating to the second zero crossing $ZC_2$, and $t_2$ may be a moment in time at which the processor circuit receives a relay status output representative of the first switching. In a further related embodiment, the processor circuit may be further configured to output the at least one subsequent relay control signal after the calibrated delay, relative to a zero crossing of the line voltage, such that the subsequent switching occurs closer in time to the at least one zero crossing $ZC_n$ than the first switching occurs relative to the second zero crossing $ZC_2$. In another further related embodiment, the subsequent switching may occur at or substantially at the at least one zero crossing $ZC_n$.

In another embodiment, there is provided a method. The method includes: outputting a line status output representative of a first zero crossing $ZC_1$ of a line voltage from a line status circuit; outputting at least one first relay control signal from a processor circuit in response to the line status output after a known delay time D3, relative to the first zero crossing $ZC_1$; first switching a relay in response to the first relay control signal, so as to couple and decouple second and third line voltage inputs with the relay, the relay further coupled to a first line voltage input, the first switching occurring relative to a second zero crossing $ZC_2$ of the line voltage; outputting a relay status output representative of the first switching; calculating an error D4 with the processor circuit, wherein the error D4 correlates to the time elapsing between a moment $t_1$ of the second zero crossing $ZC_2$ and a moment $t_2$ wherein the processor circuit receives the relay status output; and outputting at least one subsequent relay control signal from the processor circuit, so as to trigger a subsequent switching of the relay, relative to at least one subsequent zero crossing $ZC_n$ of the line voltage; wherein the subsequent switching occurs closer in time to the at least one subsequent zero crossing $ZC_n$ than the first switching occurs relative to the second zero crossing $ZC_2$.

In a related embodiment, the method may further include: outputting a first control pulse and at least one subsequent control pulse from a trigger circuit in response to the at least one first relay control signal and the at least one subsequent relay control signal, respectively; and switching the relay in response to the at least one first control pulse and the at least one subsequent control pulse, respectively. In another related embodiment, the method may further include: powering the line status circuit, the processor circuit, the relay status circuit, and the relay with a power supply circuit. In still another related embodiment, the method may further include: calculating with the processor circuit a calibrated delay from the error D4 and the known delay time D3. In a further related embodiment, the method may further include: outputting the at least one subsequent relay control signal from the processor circuit after the calibrated delay, relative to a zero crossing of the line voltage, such that the subsequent switching occurs closer in time to the at least one zero crossing $ZC_n$ than the first switching occurs relative to the second zero crossing $ZC_2$. In a further related embodiment, the method may further include: outputting the at least one subsequent relay control signal from the processor circuit after the calibrated delay, relative to a zero crossing of the line voltage, such that the subsequent switching occurs at or substantially at the at least one zero crossing $ZC_n$.

In another embodiment, there is provided an article comprising a tangible storage medium having calibration instructions stored thereon, which when executed by a processor result in operations comprising: outputting a line status output representative of a first zero crossing $ZC_1$ of a line voltage from a line status circuit; outputting at least one first relay control signal from a processor circuit in response to the line status output after a known delay time D3, relative to the first zero crossing $ZC_1$; first switching a relay in response to the first relay control signal, so as to couple and decouple second and third line voltage inputs with the relay, the relay further coupled to a first line voltage input, the first switching occurring relative to a second zero crossing $ZC_2$ of the line voltage; outputting a relay status output representative of the first switching; calculating an error D4 with the processor circuit, the error D4 correlating to the time elapsing between a moment $t_1$ of the second zero crossing $ZC_2$ and a moment $t_2$ wherein the processor circuit receives the relay status output; and outputting at least one subsequent relay control signal from the processor circuit signal so as to trigger a subsequent switching of the relay, relative to at least one subsequent zero crossing $ZC_n$ of the line voltage; wherein the subsequent switching occurs closer in time to the at least one subsequent zero crossing $ZC_n$ than the first switching occurs relative to the second zero crossing $ZC_2$.

In a related embodiment, the calibration instructions when executed by the processor may result in additional operations including: outputting a first control pulse and at least one subsequent control pulse from a trigger circuit in response to the at least one first relay control signal and the at least one subsequent relay control signal, respectively; and switching the relay in response to the at least one first control pulse and the at least one subsequent control pulse, respectively. In another related embodiment, the calibration instructions when executed by the processor may result in additional operations including: calculating with the processor circuit a calibrated delay from the error D4 and the known delay time D3. In a further related embodiment, the calibration instructions when executed by the processor may result in operations comprising: outputting the at least one subsequent relay control signal from the processor circuit after the calibrated delay, relative to a zero crossing of the line voltage, such that the subsequent switching occurs closer in time to the at least one zero crossing $ZC_n$ than the first switching occurs relative to the second zero crossing $ZC_2$. In another further related embodiment, the calibration instructions when executed by the processor may result in operations comprising: outputting the at least one subsequent relay control signal from the processor circuit after the calibrated delay, relative to a zero crossing of the line voltage, such that the subsequent switching occurs at or substantially at aid at least one zero crossing $ZC_n$.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
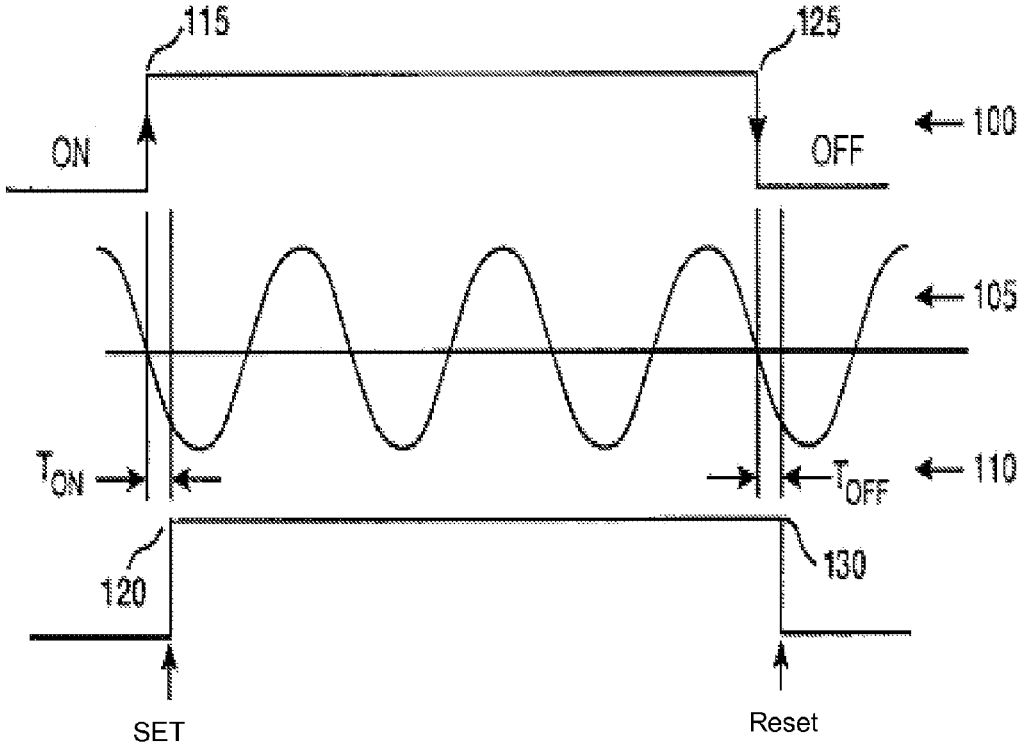
FIG. 1 shows a timing diagram illustrating the switching of a relay at points other than a zero crossing of an AC line voltage.

Embodiments described herein relate to circuitry, systems and methods that address the need to coordinate relay switching with another event, such as a zero crossing of an alternating current (AC) voltage waveform. To this end, embodiments include elegant systems, circuit designs and methods that may enable relay switching at or substantially at the zero crossing of an AC waveform. Also described herein are systems and methods that continuously or periodically calibrate the timing of control signals to a relay, such that the switching of the relay in response to some (e.g., second or subsequent) control signals occurs closer in time to a zero crossing of an AC line voltage than the switching of the relay in response to other (e.g., initial or first) control signals. In some embodiments, the calibration may allow the circuits described herein to achieve zero-cross switching or substantially zero cross switching, despite the possible variation in the set and reset time that may occur between relays, or over the lifetime of a relay.

As used herein, the terms "circuitry," and "circuit" include, for example, singly or in any combination, hardwired circuitry, programmable circuitry, state machine circuitry, and/or firmware that stores instructions executed by programmable circuitry. Also as used herein, the terms "control signal" and "control pulse" are used interchangeably to refer to signals that switch a relay from set (closed) to reset (open) and/or vice versa. The term "coupled" as used herein refers to any connection, coupling, link or the like by which signals carried by one system element are imparted to the "coupled" element. Such "coupled" devices, or signals and devices, are not necessarily directly connected to one another and may be separated by intermediate components or devices that may manipulate or modify such signals. Likewise, the terms "connected" or "coupled" as used herein in regard to mechanical or physical connections or couplings is a relative term and does not require a direct physical connection. The phrase "zero cross switching," when used in reference to an AC line voltage, means that switching of a relay occurs at one or more points in the waveform where the line voltage transitions from negative to positive (i.e., where the line voltage equals OV) or vice versa. The terms, "substantially" and "about," when used in connection with an amount or other reference point, means plus or minus 5% of the amount or other reference point. Thus the phrase, "substantially zero cross switching" means that switching of a relay occurs within +/−5% of the stated line voltage, relative to a zero crossing point of that line voltage. Thus, if an AC power line has a line voltage of 120V, "substantially zero cross switching" means that relay switching occurs within +/−6V of a zero crossing point of that line voltage. In some embodiments, relay switching occurs within +/−1% of the stated line voltage, relative to a zero crossing point of that line voltage.

As used herein, the term "relay switching," refers to the making and breaking of electrical contact in a relay. The terms "switch" and "switching" when used in the context of a relay are used interchangeably with the term "relay switching," and have the same meaning as "relay switching." "Set time," and "relay set time" are interchangeably used herein, and mean the time period elapsing between when a relay is instructed to close (e.g., by a control signal), and when electrical contact is made with the relay. "Reset time" and "relay reset time" are interchangeably used herein, and mean the time period elapsing between when a relay is instructed to open (e.g., by a control signal), and when electrical contact is broken by the relay. For the purposes of embodiments described herein, relays having set times and reset times that are the same or different may be used.

Figure 2A:
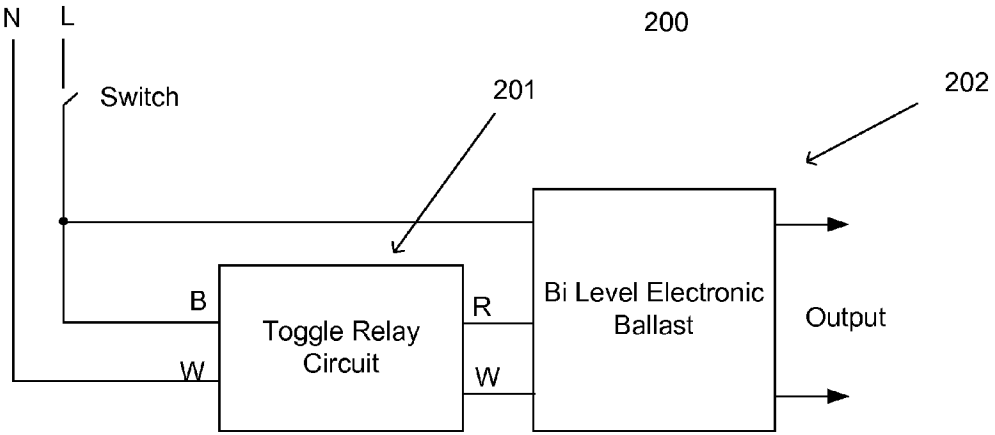
FIG. 2A is a simplified block diagram illustrating a relay according to embodiments disclosed herein.
Figure 2B:
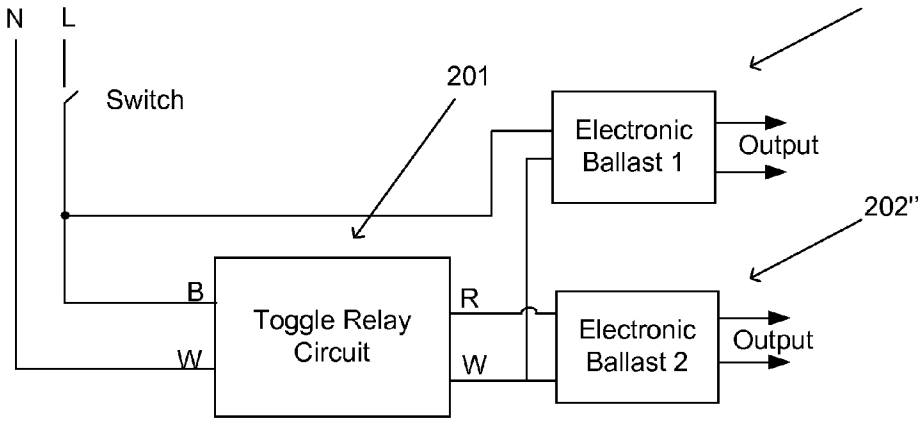
FIG. 2B is a simplified block diagram illustrating a relay according to embodiments disclosed herein.

As noted above, a relay may be used as a switch for turning a variety of electrical loads ON and OFF. As non-limiting examples of such loads, mention is made of electronic ballasts used in lighting circuits. In this regard, reference is made to FIGS. 2A and 2B, which illustrate embodiments of a system 200. In FIGS. 2A and 2B, a toggle relay circuit 201 is used to switch a bi-level electronic ballast 202 (FIG. 2A) or one of two electronic ballasts 202' and 202" (FIG. 2B) ON and OFF. Of course, other types of electrical loads may be used, and are contemplated by the present disclosure. Further, while FIGS. 2A, 2B, 3, and 4 illustrate the use of toggle relays, it should be understood that other types of relays may be used, and are contemplated by the present disclosure.

Figure 3:
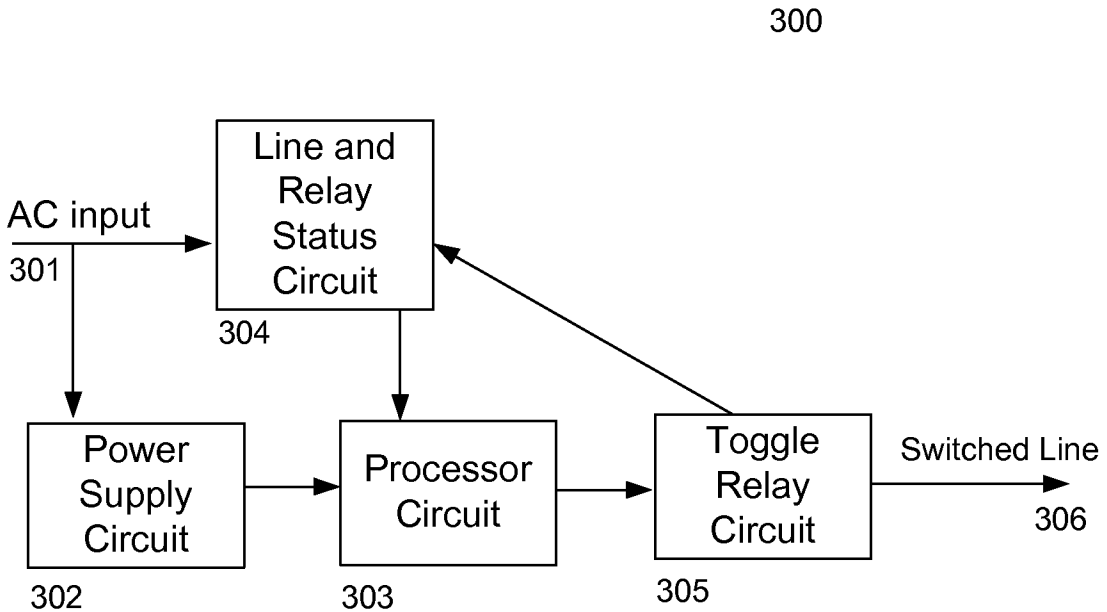
FIG. 3 is a simplified block diagram of a system including a relay according to embodiments disclosed herein.

FIG. 3 is a block diagram of a system 300 that includes an input power line 301, a power supply circuit 302, a processor circuit 303, a line and relay status circuit 304, a toggle relay circuit 305, and a switched line 306. The input power line 301 provides a line voltage to the system 300. The line voltage may be of any value, and may be an AC line voltage. In some embodiments, the line voltage ranges from about 100V to about 300V, and in some embodiments, from about 120V to about 277V. Of course, higher and lower line voltages are contemplated, and may be used in accordance with the present disclosure. The line voltage may also be supplied to the system 300 at any frequency. In some embodiments, the line voltage is an AC line voltage supplied at about 60 hertz (Hz) or about 50 Hz.

The line and relay status circuit 304 may be configured to monitor the status of the input power line 301. For example, when the input power line 301 delivers AC power to the system 300, the line and relay status circuit 304 may be configured to monitor the AC line voltage of the input power line 301. In some embodiments, the line and relay status circuit 304 monitors the zero crossing of the AC line voltage, and generates a line status output representative of a zero crossing of the AC line voltage. The line status output generated by the line and relay status circuit 304 may take the form of any of a wide variety of electrical signals. For example, the line and relay status circuit 304 may be configured to generate square waves (e.g., TTL square waves) or other electronic signals, wherein a feature of such square waves or other electronic signals is representative of a zero crossing of the AC line voltage of the input power line 301. In some cases, one or more features of the line status output coincide with a zero crossing of the AC voltage of the input power line 301. For example, where the line status output takes the form of square waves, one or more of the HIGH/LOW and/or LOW/HIGH transitions of the square waves may coincide or substantially coincide with a zero crossing of the AC line voltage. In some embodiments, the line status output takes the form of square waves, and at least one of the HIGH/LOW and LOW/HIGH transitions of those square waves coincide with half cycle zero crossings of the AC line voltage.

In addition to monitoring the status of the input power line 301, the line and relay status circuit 304 may monitor the status of the toggle relay circuit 305. In some embodiments, the line and relay status circuit 304 monitors a voltage that is representative of the setting and resetting of the toggle relay circuit 305. For example, when the toggle relay circuit 305 is set (closed), the line and relay status monitoring circuit 304 may output square waves, wherein a rising and falling of the square waves correlates to a zero crossing of the line voltage. When the toggle relay circuit 305 is reset (open), the line and relay status circuit 304 may output a voltage (relay status output) that is at a logic HIGH (e.g., 1) or a logic LOW (e.g., 0). In this regard, reference is made to the operation of the toggle relay circuit 305, which is described in greater detail below.

As explained previously, the line and relay status circuit 304 may monitor the status of the toggle relay circuit 305, and generate a relay status output that is representative of the setting (closing) and resetting (opening) of the toggle relay circuit 305. Like the line status output, the relay status output may take the form of square waves (e.g., TTL square waves) or other electronic signals. Moreover, a feature of the relay status output signal may coincide with the setting and/or resetting of the toggle relay circuit 305. For example, where the relay status output takes the form of square waves, at least one of the HIGH/LOW and LOW/HIGH transitions of such square waves may coincide with the setting or resetting of the toggle relay circuit 305. Regardless of their form, the line status output and relay status output may be monitored by the processor circuit 303, and used in the calibration of systems employing a relay, as described in detail below.

Figure 4:
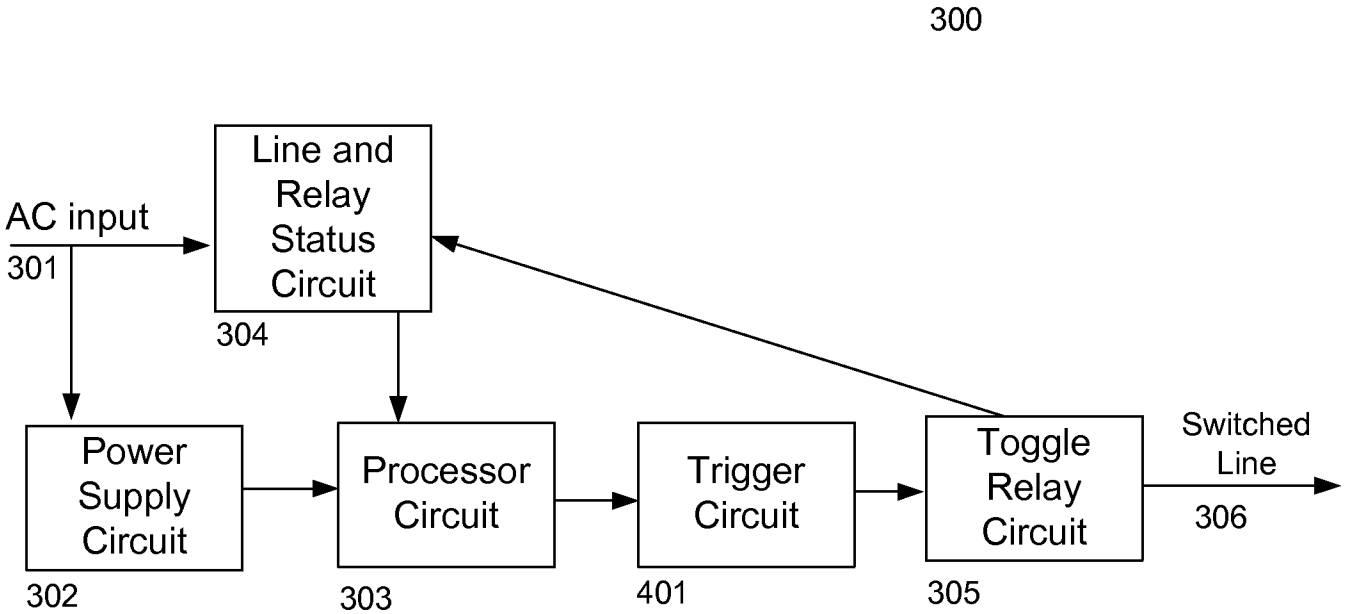
FIG. 4 is a simplified block diagram of a system according to embodiments disclosed herein.

It should be understood that while FIGS. 3 and 4 depict the line and relay status circuit 304 as a single circuit, the use of a single circuit to perform these functions is not required (see, e.g., the description of FIG. 6A below). In some embodiments, separate line status circuitry and relay status circuitry are used to monitor the status of the input power line 301 and the toggle relay circuit 305, respectively. Thus, the description herein of the joint function of the line and relay status circuit 304 should be understood to apply to systems wherein one or more separate line status circuits and relay status circuits are used, with the understanding that the line status circuit(s) monitor the line status of the input power line 301, and the relay status circuit(s) monitor the status of the toggle relay circuit 305.

The processor circuit 303 is generally configured to output control signals or trigger the downstream output of control signals that cause the toggle relay circuit 305 to switch from set (closed) to reset (open), and vice versa. In some embodiments, the processor circuit 303 generates control signals that trigger setting and resetting of the toggle relay circuit 305. Alternatively, or additionally, in other embodiments, the processor circuit 303 outputs signals that trigger the generation of control signals (e.g., control pulses) from a downstream trigger circuit, such as a trigger circuit 401 shown in FIG. 4. Regardless, it should be understood that the processor circuit 303 generates one or more control signals, and the toggle relay circuit 305 switches in response to those control signals or control pulses generated in response to those control signals, e.g., by a downstream trigger circuit.

The toggle relay circuit 305 is generally configured to couple or decouple two or more lines (e.g., voltage inputs) in response to a control signal and thus, control the status of the switched line 306. In this regard, the toggle relay circuit 305 acts as a switch. When the toggle relay circuit 305 is set (closed), it couples two or more lines to one another and a current may flow through the switched line 306 (i.e., the switched line 306 is "present"). Alternatively, when the toggle relay circuit 305 is reset (open), it decouples those lines, and no current flows through the switched line 306 (i.e., the switched line 306 is not present). In some instances, the toggle relay circuit 305 is coupled to first, second and third line voltage inputs, and is configured to couple and decouple the second and third line voltage inputs in response to one or more control signals output by the processor circuit 303. In any case, it should be understood that the voltage along the switched line 306 (including, e.g., the presence and absence thereof) may be indicative of the switching of the toggle relay circuit 305. As noted above, the line and relay status circuit 304 may monitor such voltage and thus, output a relay status output representative of the switching of the toggle relay circuit 305.

Circuit diagrams for each of the aforementioned components of the system 300 will be described later with respect to FIGS. 6A and 6B. For the purpose of clarity, however, operation of the aforementioned components using the general descriptions provided above will next be provided.

As noted above, the processor circuit 303 is generally configured to output control signals that cause the toggle relay circuit 305 to switch from set to reset, or vice versa. For example, the processor circuit 303 may output control signals that are timed in such a way as to coordinate the switching of the toggle relay circuit 305 with a zero crossing of a line voltage supplied by the input power line 301. In some embodiments, the processor circuit 303 outputs at least one first control signal at a time TC after a default delay D3 (described below) relative to a zero crossing of the line voltage. The first control signal triggers a first switching of the toggle relay circuit 305. The processor circuit 303 may then output at least one subsequent control signal at a time TC' after a calibrated delay, relative to a subsequent zero crossing of the line voltage. The calibrated delay takes into account certain delays (errors) in the system, in particular an error D4 (described in detail below). As a result, the at least one subsequent control signal is timed such that the at least one subsequent switching of the toggle relay circuit 305 occurs closer in time to a zero crossing of an AC line voltage, relative to the switching of the toggle relay circuit 305 in response to the first control signal sent at time TC (i.e., after the default delay D3). In some embodiments, the switching of the toggle relay circuit 305 in response to control signals sent after a calibrated delay (e.g., at time TC') occurs at or substantially at a zero crossing point of the line voltage.

As explained previously, real relays are not always instantaneously responsive to an input. That is, real relays often exhibit non-zero set and/or reset times. Moreover, the set and reset times of individual relays within a pool of identically configured relays may vary from one another. Moreover, the set and/or reset time of a particular relay may vary over time, e.g., based on factors such as the age and usage history of the relay. As a result, the precise values of the set time and/or reset time of a particular relay may not be known. Alternatively, the precise values of the set time and/or reset time of a particular relay may be precisely known or reported, but are unreliable for adjusting the timing of control signals. To address this issue, the processor circuit 303 may be configured with a timer circuit that dictates the moment at which control signals are generated by the processor circuit 303. Initially, the timer circuit may be set so as to cause the processor circuit 303 to generate at least one first control signal after a default delay, or D3. Generally, the value of the default delay D3 is selected so as to enable the processor circuit 303 to determine an error D4 associated with the set and/or reset time of the toggle relay circuit 305. As will be discussed in detail below, the processor circuit 303 may determine the error D4 by monitoring the line status output, and monitoring the relay status output in response to the at least one first control signal sent. Accordingly, the default delay D3 may be set at a value less than the interval between zero crossings of the AC voltage, i.e. at a value less than (½)f, where f is the frequency of the AC line voltage. Moreover, the value of the default delay D3 may be chosen based on known information regarding the toggle relay circuit 305, such as the average relay switch time reported for a pool of identical toggle relays. For example, if the average set and/or reset time of a pool of relays is 5 milliseconds, the default delay D3 may be set at about 5 milliseconds.

The use of the default delay D3 according to embodiments described herein is described in connection with an exemplary timing diagram shown in FIG. 5A. As shown, an AC line voltage supplied by the input power line 301 exhibits an AC voltage waveform 501 with a period of 1/f, where f is the frequency of the AC voltage waveform 501 in Hertz. Zero crossings ($ZC_0$, $ZC_1$, $ZC_n$ . . . ) of the AC voltage waveform 501 occur at the half cycle. Thus, a time period (interval) D2 will elapse between respective half cycle zero crossings, where D2=1/(2f). Accordingly, the if AC voltage waveform 501 has a frequency of 60 Hz, it will exhibit a half cycle zero crossing approximately every 8.33 milliseconds (1/120 Hz).

Figure 5B:
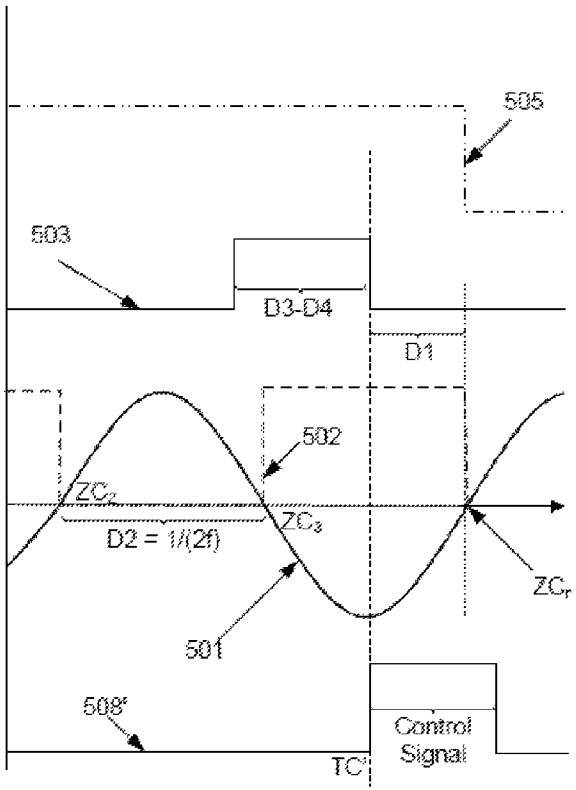
FIG. 5B is a timing diagram of a system wherein a processor circuit emits at least one subsequent control signal at a time TC' after a known delay time D3—an error time D4 from a third zero crossing $ZC_3$, according to embodiments disclosed herein.
Figure 5A:
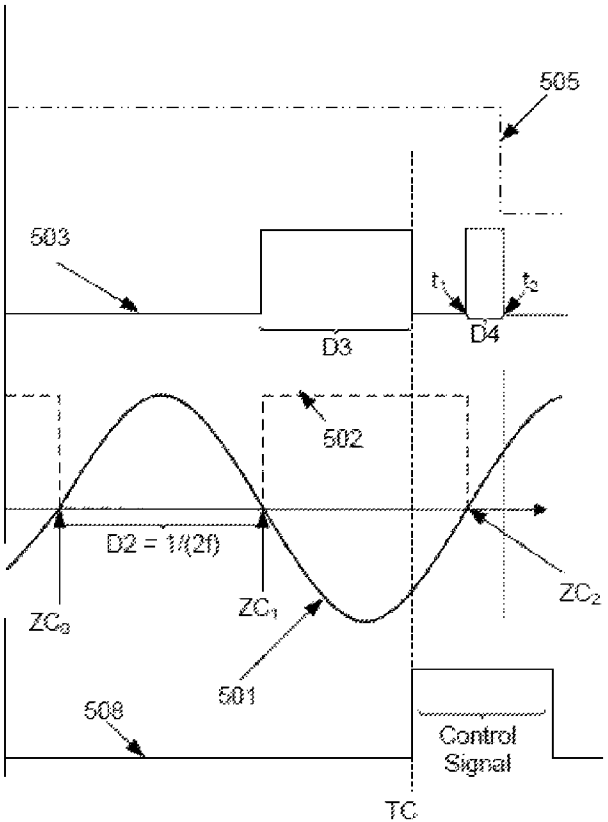
FIG. 5A is a timing diagram of a system wherein a processor circuit generates at least one first control signal at a time TC after a known delay time D3 from a first zero crossing $ZC_1$, according to embodiments disclosed herein.

With further reference to FIG. 5A, the line and relay status circuit 304 monitors the status of the AC line voltage (or more specifically, the AC voltage waveform 501), and generates a line status output 502. As shown, the HIGH/LOW and LOW/HIGH transitions of the line status output 502 substantially coincide with the half cycle zero crossings ($ZC_0$, $ZC_1$, $ZC_2$ . . . ) of the AC voltage waveform 501 and thus, may be considered "representative" of such zero crossings. Likewise, the line and relay status circuit 304 monitors the status of the toggle relay circuit 305, and generates a relay status output 505. Similar to the line status output 502, the relay status output 505 includes features that are representative of the switching of the toggle relay circuit 305. For example, and as shown in FIGS. 5A and 5B, the relay status output 505 may include a HIGH/LOW transition substantially coinciding with the setting (closing) of the toggle relay circuit 305 and thus may be considered representative of that setting.

While the line status output 502 and the relay status output 505 are illustrated in FIGS. 5A and 5B in the form of square waves, other wave forms may of course be used without departing from the scope of the invention. Moreover, the line status output 502 need not exhibit characteristics that are representative of every zero crossing of the AC line voltage. Indeed, the line status output 502 may be configured to exhibit characteristics that substantially coincide with zero crossings occurring at the full cycle (D2=1/f), every third half cycle (D2=1.5/f), etc. Likewise, features of the line status output 502 and the relay status output 505 need not coincide or substantially coincide with the zero crossing of the AC voltage waveform 501 or the switching of a relay, respectively. For example, features of the line status output 502 and/or the relay status output 505 may occur at some time period (offset) before or after a zero crossing of the AC voltage waveform 501 and/or a switching of the toggle relay circuit 305, respectively. In such cases, the processor circuit 303 may be configured to account for such offset according to embodiments described herein.

In some embodiments, the processor circuit 303 outputs a first control signal 508 in response to a line status output 502 representative of zero crossing $ZC_1$. As shown in FIG. 5A, the first control signal 508 is generated after the processor circuit 303 receives a line status output representative of zero crossing $ZC_1$. More specifically, the first control signal 508 is generated at time TC after the default delay D3, relative to zero rossing $ZC_1$. As noted above, the set and/or reset time of the toggle relay circuit 305 may not be precisely known, and may vary over the lifetime of the part. As a result, it is possible that the switching of the toggle relay circuit 305 in response to the first control signal may not occur at or substantially at a zero crossing of an AC line voltage, even if the default delay D3 is initially set in accordance with a reported (or otherwise known) set and/or reset time of the toggle relay circuit 305. In other words, because the default delay D3 does not take into account the variability of the relay switching time, first control signals generated at point TC (i.e., after the default delay D3) may not be timed appropriately to cause the toggle relay circuit 305 to switch at or substantially at a zero crossing of an AC line voltage. This issue is illustrated in FIG. 5A, wherein the relay status 505 changes from HIGH to LOW after zero crossing $ZC_2$ of the AC voltage waveform 501. This indicates that the toggle relay circuit 305 switched from open to closed in response to the first control signal 508 after $ZC_2$. As discussed previously, switching of the toggle relay circuit 305 at points other than a zero crossing of the AC waveform 501 may result in damage to the toggle relay circuit 305 or other components of the system. Because the switching of the toggle relay circuit 305 in response to the first control signal 508 may occur at a time other than a zero crossing of the AC voltage waveform 501, the first control signal 508 may be considered "uncalibrated."

To address this issue, the processor circuit 303 may be configured to adjust the timing of the control signals generated by the processor circuit 303, such that the toggle relay circuit 305 switches from set to reset at a desired point in time. For example, the processor circuit 303 may time the output of control signals such that the toggle relay circuit 305 switches at or substantially at a zero crossing of an AC voltage waveform. In some embodiments, the processor circuit 303 performs this adjustment by calculating an error D4, which correlates to the time elapsing between a target zero crossing point (e.g., $ZC_2$ in FIG. 5A) and the time at which the toggle relay circuit 305 switches in response to the first control signal 508. After determining the error D4, the processor circuit 303 may output subsequent control signals 508' after a calibrated delay, relative to a zero crossing of the AC voltage waveform 501. In general, the calibrated delay time adjusts the default delay D3 by an amount corresponding to the error D4. If the toggle relay circuit 305 switches after a target zero crossing in response to the first control signal (i.e., the default delay D3 was too long), the calibrated delay may be calculated by subtracting the error D4 from the default delay D3. If the toggle relay circuit 305 switches before a target zero crossing in response to the first control signal (i.e., the default delay D3 was too short), the calibrated delay may be calculated by adding the error D4 to the default delayD3. Thus, while the following description focuses on instances wherein the default delay D3 was too long, it should be understood that such description applies to scenarios wherein the default delay D3 was too short.

Accordingly, the processor circuit 303 may adjust the timing of subsequent control signals using the calibrated delay (i.e., D3−D4, or D3+D4, as the case may be). By adjusting the timing of subsequent control signals in this way, the toggle relay circuit 305 may switch in response to those subsequent control signals 508' at or closer in time to a zero crossing of the input line voltage, relative to the switching of the toggle relay circuit 305 in response to the at least one first control signal 508. This is illustrated in FIG. 5B, wherein the subsequent control signal 508' is output at a time TC' after D3−D4 (relative to zero crossing point $ZC_3$), and the relay status output 505 exhibits a HIGH/LOW transition at or substantially at zero crossing point $ZC_n$.

Using the above methods, the processor circuit 303 may also determine a calibrated set (or reset) time D1 of the toggle relay circuit 305. The calibrated set (or reset) time D1 is shown in FIG. 5B, and may be calculated by the processor circuit 303 using the function D1=D2−(D3−D4), wherein D2=½f (or another zero crossing point) and f is the frequency of the AC line voltage. Because D2, D3, and D4 are known (or calculated as described herein), D1 may be calculated.

From the foregoing description, it should be understood that the default delay D3 may be fixed in hardware, or may be variable and set by a user. In any case, the default delay D3 may be a known value. However, because the set and/or reset time of a relay may vary over the relay's lifetime, the error D4 may be unknown, or may be known but unreliable for the purpose of timing the output of the subsequent control signals 508' (e.g., in the case of a prior calibration that has gone "bad"). To address this issue, the processor circuit 303 may be configured to calculate the error D4 using the line status output 502 and the relay status output 505, as discussed below.

In some embodiments, D4 is determined or calculated by the processor circuit 303 outputting at least one first control signal at a known time relative to a first zero crossing point. For example, and as shown in FIG. 5A, the processor circuit 303 may output the first control signal 508 at the time TC after an uncalibrated delay time D3 relative to zero crossing point $ZC_1$. The processor circuit 303 records the moment in time ($t_1$) at which a zero cross switching of the toggle relay circuit 305 is desired. In FIG. 5A, $t_1$ correlates to zero crossing point $ZC_2$, which may be determined by the processor circuit 303 from the line status output 502, or calculated using the equation ½f. The values of D3, $t_1$ and $t_2$ are graphically illustrated in FIG. 5A using a time line 503. After recording time $t_1$, the processor circuit 303 starts a timer, and monitors the relay status output 505 for features indicative of a switching of the toggle relay circuit 305, e.g., the HIGH/LOW transition shown in FIG. 5A. The processor circuit 303 records the moment in time ($t_2$) at which it receives a relay status output 505 that is indicative of the switching (i.e., setting or resetting) of the toggle relay circuit 305 from set to reset, or vice versa. The processor circuit 303 may then calculate the error D4 by subtracting $t_1$ from $t_2$. That is, $D4=t_2-t_1$.

As noted above, the error D4 may be used to calculate a calibrated delay, which may be used to adjust the timing of the output of at least one subsequent control signal 508'. Specifically, the processor circuit 303 may calculate a calibrated delay time by offsetting (positively or negatively, as the case may be) the default delay D3 by an amount corresponding to the error D4. For example, if the default delay D3 is too long (resulting in the switching of the toggle relay circuit 305 after a target zero crossing), the processor circuit 303 may subtract D4 from D3, and output subsequent control signal(s) 508' by an amount corresponding to D3−D4, relative to a zero crossing point. By incorporating the error D4 in the calculation of the calibrated delay, the subsequent control signals 508' may be timed such that the toggle relay circuit 305 will switch at or substantially at a subsequent zero crossing of the AC voltage waveform 501. For example, if the first control signals 508 are sent in response to a line status output 502 representative of zero crossing point $ZC_1$, the error D4 may be determined based on a subsequent zero crossing, e.g., $ZC_2$ in FIG. 5A. The processor circuit 303 may then output subsequent control signals 508' after the calibrated delay, relative to a subsequent zero crossing point. For example, and as shown in FIG. 5B, the subsequent control signal 508' may be sent at time TC' after (D3−D4) from zero crossing point $ZC_3$ of the AC voltage waveform 501. The toggle relay circuit 305 will switch in response to the subsequent control signals 508' at a point relative to another subsequent zero crossing of the AC voltage waveform 501 (e.g., $ZC_n$ in FIG. 5B).

In some embodiments, the switching of the toggle relay circuit 305 in response to the subsequent control signal 508' occurs closer in time to a zero crossing point than the switching of the toggle relay circuit 305 in response to the first control signal 508. For example, the switching of the toggle relay circuit 305 in response to the subsequent control signals 508' may occur at or substantially at a subsequent half cycle zero crossing of the AC voltage waveform 501.

In this way, the processor circuit 303 may calibrate the timing of the output of control signals so as to facilitate the coordination of the switching of the toggle relay circuit 305 with a zero crossing of an AC voltage waveform. While embodiments described in relation to FIGS. 5A and B demonstrate this calibration with respect to half cycle zero crossings $ZC_3$ and $ZC_n$, it should be understood that the processor circuit 303 may time the output of control signals to coordinate switching of the toggle relay circuit 305 with any desired zero crossing of an AC voltage waveform. In some cases, the processor circuit 303 outputs at least one subsequent control signal that is timed so as to coordinate the switching of the toggle relay circuit 305 with a full cycle zero crossing of AC voltage waveform.

For illustration only, and with reference to FIG. 5B, consider a scenario in which the processor circuit 303 sends at least one subsequent control signal 508' to the toggle relay circuit 305 at time TC' after D3−D4 relative to zero crossing $ZC_3$ of the AC voltage waveform 501. If D3 is 5 milliseconds, and D4 is 1 millisecond, D3−D4=4 milliseconds. Thus, in this non-limiting example, the processor circuit 303 would the at least one output subsequent control signal 508' 4 milliseconds after zero crossing $ZC_3$ of the AC voltage waveform 501. As a result, the toggle relay circuit 305 switches at or substantially at subsequent zero crossing $ZC_n$ of the AC voltage waveform 501 in response to the at least one subsequent control signal 508'. This switching is illustrated in FIG. 5B, wherein the relay status output 505 exhibits a HIGH/LOW transition at or substantially at half cycle zero crossing point $ZC_n$.

As previously explained, the processor circuit 303 may be configured to output control signals to the toggle relay circuit 305 directly. In some embodiments, however, the processor circuit 303 outputs signals that cause the generation of control signals and/or pulses by downstream components, such as the switching circuit 401 shown in FIG. 4. For example, the processor circuit 303 may generate signals that cause the switching circuit 401 to emit control pulses or signals, such as square waves, which ultimately trigger the switching of the toggle relay circuit 305. As a non-limiting example of such a trigger circuit, mention is made of Schmitt triggers, the design and construction and operation of which are understood in the art. Non-limiting examples of Schmitt triggers that may be used in accordance with the present disclosure include inverting Schmitt triggers and non-inverting Schmitt triggers. Of course, the trigger circuit 401 need not be configured as a Schmitt trigger. For example, the trigger circuit 401 may be built through the use of separate N-MOS and P-MOS transistors. In some embodiments, the switching circuit 401 is configured as a Schmitt trigger that acts as a buffer between the processor circuit 303 and the toggle relay circuit 305, so as to provide an output current. In some embodiments, the output current of the switching circuit 401 exceeds the current driven by the pins of the processor circuit 303. For example, where pins of the processor circuit 303 drive a 20 mA current, the switching circuit 401 may be configured to provide an output current greater than 20 mA, such as 50 mA or more. The switching circuit 401 may also serve to provide protection to the processor circuit 303.

Because the trigger circuit 401 is responsive to an input from the processor circuit 303 and may not be an ideal circuit, a delay may arise between when the trigger circuit 401 receives a signal from the processor circuit 303, and when the trigger circuit 401 outputs control signals or pulses to the toggle relay circuit 305. While the potential additional delay introduced by the trigger circuit 401 may be independently monitored, such independent determination may not be required. This is the because processor circuit 303 may determine the error D4 by monitoring the time elapsing between a target zero crossing point and the time at which it receives a relay status output representative of the switching of the toggle relay circuit 305. Moreover, delays introduced by the trigger circuit 401 may be known and or consistent and thus may be accounted for in the setting of the default delay D3, or included in the calculation of the calibrated delay as a separate factor.

Figure 6A:
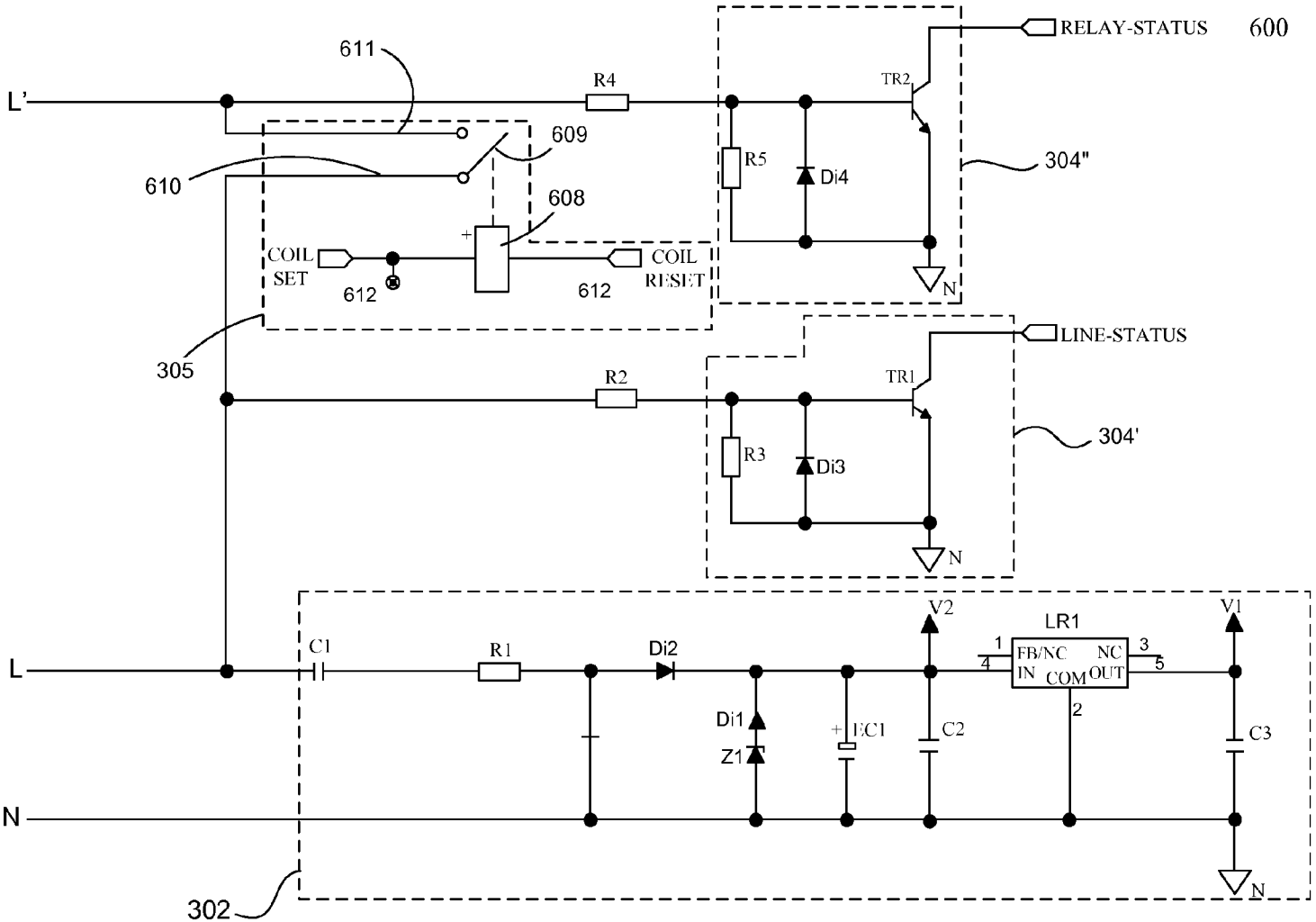
FIG. 6A is circuit diagram of one portion of a system according to embodiments disclosed herein.
Figure 6B:
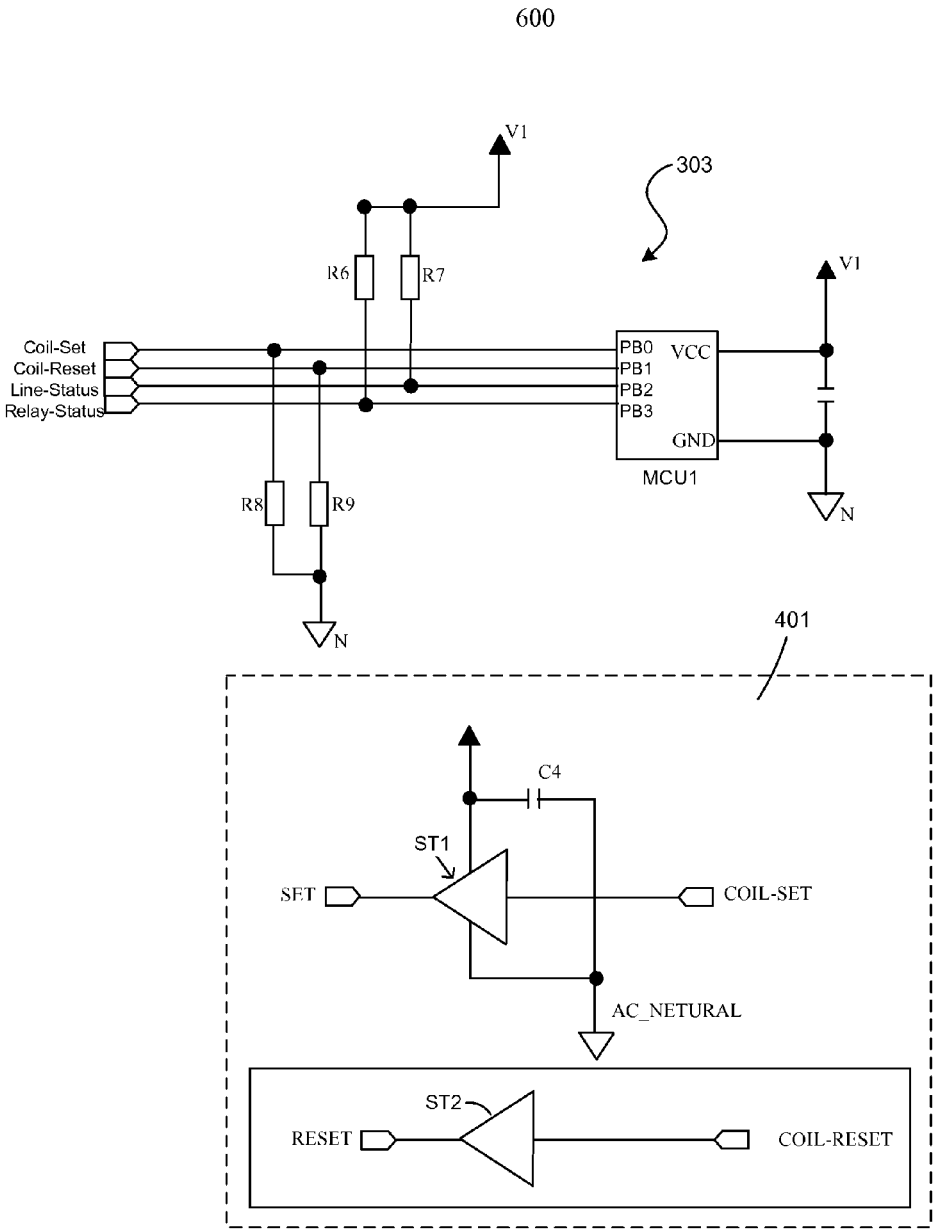
FIG. 6B is a circuit diagram of another portion of a system according to embodiments disclosed herein.

FIGS. 6A and 6B provide a circuit diagram of a system 600 containing a relay according to embodiments described herein. The system 600 includes a power supply circuit 302, a processor circuit 303, a trigger circuit 401, a line status circuit 304', a relay circuit 305, and a relay status circuit 304". Also shown are a neutral line N, a hot line L, and a switch line L'. In some embodiments, the switch line L' correlates to a switchable line of a load, such as but not limited to an electronic ballast. In general, the power supply circuit 302 rectifies AC voltage input through the line L with a capacitor C1, a resistor R1, diodes Di1 and Di2, and a Zener Diode Z1. The output is clamped to the voltage of the Zener diode Z1, e.g., at about 12-13V. A polarized capacitor (e-cap) EC1 and a capacitor C2 moderate the voltage and the current flux of the rectifier portion of the power supply circuit 302. The output is then fed to a linear regulator LR1, which down regulates the voltage to produce one or more voltage outputs suitable for other components of the system 600. For example, the linear regulator LR1 may output a voltage V1 of about 5V, and a voltage V2 of about 13V. The processor circuit 303 includes a microcontroller MCU1, which may be configured with multiple pins for transmitting and receiving signals. A wide variety of processors and/or microcontrollers may be used as the processor circuit 303. As a non-limiting example of a suitable microcontroller that may be used as the microcontroller MCU1, mention is made of the ATtiny45 microcontroller produced by ATMEL®.

As shown in FIG. 6B, the microcontroller MCU1 may include pins PB0 and PB1 for transmitting set and reset signals to a coil 608 of the toggle relay circuit 305, respectively. The microcontroller MCU1 may further include pins PB2 and PB3 for receiving a line status output from the line status circuit 304' and a relay status output from the relay status circuit 304", respectively. Pull-up resistors R6 and R7 are coupled to input lines connected to the pins PB2 and PB3, and pull down resistors R8 and R9 are coupled to output lines connected to the pins PB0 and PB1.

The trigger circuit 401 includes Schmitt triggers ST1 and ST2, which drive the setting and resetting of the toggle relay circuit 305, respectively. Either or both of the Schmitt triggers ST1 and ST2 may include a bypass capacitor (e.g., a capacitor C4), but for the sake of illustration only the Schmitt trigger ST1 is shown as including such a capacitor. The Schmitt triggers ST1 and ST2 receive signals from the processor circuit 303, and output control pulses of a desired length and voltage. For example, the Schmitt triggers may output control pulses having a length of about 20 ms at 5V. In some embodiments, the Schmitt triggers ST1 and ST2 operate with little or no power dissipation.

The toggle relay circuit 305 is configured to couple multiple voltage inputs with a switch. For example, the coil 608 of the toggle relay circuit 305 may receive set and/or reset signals at one or more of its inputs (first voltage input or inputs). When the toggle relay circuit 305 receives a set signal, a switch 609 closes, thereby coupling a line 610 (a second voltage input) to a line 611 (a third voltage input). When the switch 609 is closed, a current will flow through the line L', and the line L' will be "present". When the switch 609 is open, a current does not flow through the line L', and the line L' will be absent.

The line status circuit 304' and the relay status circuit 304" monitor the status of the lines L and L', respectively. The line status circuit 304' includes resistors R2, R3, a diode Di3, and a transistor TR1. Similarly, the relay status circuit 304" includes resistors R4, R5, a diode Di4, and a transistor TR2. The transistor TR1 is synchronized with the cycle of the AC voltage supplied by the line L, and switches from a high to low state (or vice versa) at any moment when the voltage of the line L exceeds a threshold voltage. For example, the voltage at a collector of the transistor TR1 may switch from digital 1 to digital 0 whenever the voltage at its base (i.e., along the line L) exceeds about 0.7 volts, and vice versa. In this way, the line status circuit 304' monitors the status of the AC voltage, and outputs square waves that are representative of a zero crossing of the AC voltage. The transistor TR2 of the relay status circuit 304" monitors the status of the voltage along the line L'. When the voltage exceeds a threshold value (e.g., 0.7 V) at a base of the transistor TR2 (e.g., when the switch 608 is closed and the line L' is "present"), the voltage at a collector of the transistor TR2 may transition from a high to low state (or vice versa). For example, the voltage at the collector of the transistor TR2 may switch from digital 1 to digital 0 whenever the voltage at its base (i.e., along the line L) exceeds about 0.7 volts, and vice versa. In this way, the relay status circuit 304" monitors the status of the toggle relay circuit 305, and outputs a relay status output (e.g., square waves) that are representative of the switching of the toggle relay circuit 305.

As described above, the processor circuit 303 receives the line status and relay status outputs from the line status circuit 304' and the relay status circuit 304", respectively. Based on these inputs, the processor circuit 303 may output one or more control signals that trigger the setting and/or resetting of the toggle relay circuit 305, and which are timed so as to coordinate such setting and resetting with a zero crossing of the AC voltage supplied by the line L. For example, the processor circuit 303 may monitor the line status output received from the transistor TR1, which is representative of a zero crossing of the AC line voltage. The processor circuit 303 may then output at least one first control signal in response to the line status output to the Schmitt trigger ST1, e.g., after a default delay D3 relative to a detected zero crossing. The Schmitt trigger ST1 receives the at least one first control signal, and outputs control pulses to the coil 608 of the relay 305. In response, the switch 609 of the relay 305 closes, coupling the lines 610 and 611, causing a current to flow along the line L'. When the voltage along the line L' exceeds a threshold voltage at the base of the transistor TR2, the voltage at the collector of the transistor TR2 switches from high to low (or vice versa), and is output to the processor circuit 303 as a relay status output. The processor circuit 303 records the moment in time ($t_1$) correlating to a target zero crossing. As described above with respect to FIG. 5A, the moment in time $t_1$ may correlate to zero crossing point $ZC_2$, which may be determined by the processor circuit 303 using the equation ½f or from the line status output 502. After recording the moment in time $t_1$, the processor circuit 303 starts a timer, and monitors the relay status output 505 for features indicative of a switching of the toggle relay circuit 305, e.g., the HIGH/LOW transition shown in FIG. 5A. The processor circuit 303 records the moment in time ($t_2$) at which it receives a relay status output 505 from the line and relay status circuit 504/504' and 504" that is indicative of the switching of the toggle relay circuit 305 from set to reset, or vice versa, in response to a first control signal. $t_2$ and/or $t_1$ may be stored in a memory (for example but not limited to an EEPROM or other separate and/or distinct memory and/or memory system) of and/or connected to the processor circuit 303 or another memory, and used to calibrate the timing of subsequent control signals. Specifically, the processor circuit 303 may calculate the error D4 by subtracting $t_1$ from $t_2$.

To coordinate the switching of the toggle relay circuit 305 with subsequent zero line crossings of the AC voltage, the processor circuit 303 incorporates the error D4 into the calculation of a calibrated delay, which is used to time the output of subsequent control signals from the processor circuit 303 and/or the trigger circuit 401. In some embodiments, and as described above, the calibrated delay time correlates to D3−D4 (or D3+D4, as the case may be), where the default delay D3 and the error D4 are defined as described above. Specifically, the processor circuit 303 may output subsequent control signals at a time TC' after a calibrated delay, relative to a subsequent zero crossing of the AC voltage. As discussed previously, the time TC' may be after a calibrated delay defined by D3−D4 (or D3+D4, as the case may be). As a result, the switching of the toggle relay circuit 305 in response to such subsequent control signals may occur closer in time to a subsequent zero crossing of the AC voltage, relative to the switching of the toggle relay circuit 305 in response to a first control signal. In some embodiments, the switching of the toggle relay circuit 305 in response to the subsequent control signals occurs at or substantially at a zero crossing point of the AC voltage.

Table 2 below identifies one example of circuit components useful in configuring the embodiments illustrated in FIGS. 6A and 6B for operation with a 120V RMs/60 Hz AC input signal (resistor values in ohms).

TABLE 2

| Component | Descriptor/Value |
|---|---|
| C1 | Film CAP/0.15 uF |
| C2 | Ceramic CAP/0.1 uF |
| C3 | Ceramic CAP/1.0 uF |
| C4 | Ceramic CAP/0.1 uF |
| R1 | Resistor/470Ω |
| R2 | Resistor/2.2 MΩ |
| R3 | Resistor/470 KΩ |
| R4 | Resistor/2.2 MΩ |
| R5 | Resistor/470 KΩ |
| R6 | Resistor/33 KΩ |
| R7 | Resistor/33 KΩ |
| R8 | Resistor/33 KΩ |
| R9 | Resistor/33 KΩ |
| Di1 | Diode/MURS160-E3/52T |
| Di2 | Diode/MURS160-E3/52T |
| Di3 | Diode/BAS16LT1G |
| Di4 | Diode/BAS16LT1G |
| Z1 | Diode/BZX84C13 |
| EC1 | Aluminum CAP/330 uF |
| LR1 | Linear regulator/TPS71550DCKR |
| TR1 | NPN Transistor/BC817-25LT1G |
| TR2 | NPN Transistor/BC817-25LT1G |
| MCU1 | Microcontroller/ATtiny45 |
| ST1 | Schmitt Trigger/74LVC2G17GW |
| ST2 | Schmitt Trigger/74LVC2G17GW |
| 305 | Relay/HFE7/5-1HST-L1 |

Another aspect of embodiments described herein relates to methods of coordinating the switching of a relay with a zero cross of an AC voltage. In some embodiments, such methods include outputting a line status representative of a zero crossing of a line voltage from a line status circuit. The methods may further include outputting at least one first relay control signal from a processor circuit and coupling and decoupling second and third line voltage inputs with a relay in response to said at least one first relay control signal, the relay further coupled to a first line voltage input. In addition, the methods may include outputting a relay status output representative of a relay switch delay time associated with said relay in response to said at least one first relay control signal. Finally, such methods may include a further step of outputting at least one subsequent relay control signal from said processor in response to said line status output and said relay status output, such that at least one subsequent coupling of said second and third line voltage inputs by said relay occurs at or closer in time to said zero crossing than said coupling and decoupling of said second and third line voltage inputs with said relay in response to said at least one first relay control signal.

The precise implementation of the methods has been described above, and so will not be repeated herein. Of course, it should be understood that methods in accordance with the present disclosure may further include outputting a first control pulse and at least one subsequent control pulse from a trigger circuit (e.g., a Schmitt trigger) in response to at least one first relay control signal and at least one subsequent relay control signal output by the processor circuit 303, respectively. The control pulses may instigate the coupling and uncoupling of the second and third line voltages by the relay, respectively.

The methods may further include powering the line status circuit, processor circuit, relay status circuit, and/or relay with a power supply circuit. Moreover, the methods may further entail outputting said at least one first relay control signal from said processor circuit after a default delay D3 from a zero crossing of a line voltage and calculating a calibrated delay, as described above.

Using the above described circuits, systems, and methods, it is possible to calibrate the timing of control signals from a processor so as to coordinate the switching of a relay with a zero crossing of an AC line voltage. Such systems and methods may be implemented in circuits that are factory calibrated, or which are uncalibrated. In the latter case, the circuits systems and methods described herein can be used to establish an initial calibration, even when the relay switch delay is not initially known. In the earlier case, the circuits, systems, and methods described herein may be implemented so as to monitor the effectiveness of the factory calibration. In either case, the processes, systems and methods may be implemented so as to update the calibration in the field, thereby maintaining desirable switching performance despite the possible variation in relay switch time over the lifetime of a part. For example, the systems, processes and methods may be implemented at periodic intervals (e.g., every 100, 250, 500, or 1000 switch cycles) so as to maintain the coordination of the relay switching with the zero crossing of the AC voltage, despite possible variation in the set and reset time of the relay that might occur over the life of the part.

Using the systems and method described herein, it is possible to coordinate the switching of a relay with a zero crossing of an AC line voltage. The systems and methods described herein may be of beneficial use to switch a variety of electrical loads, such as electrical ballasts for lighting applications. In some instances, the systems and methods may permit the use of a smaller relay to toggle a larger load, and for a larger number of cycles than could be attained using other methods. By way of example, the systems and methods described herein may permit the use of a 10A relay to switch a 300 W electrical ballast load for 50,000 cycles. In contrast, if the systems and methods described herein are not used, it may be necessary to use a 16A relay to switch a 150 W load, and such relay may only last for 20,000 cycles.

Another aspect of the present disclosure relates to machine-readable media containing instructions for performing the operations of the present disclosure, or containing design data which defines structures, circuits, apparatus, processors, and/or system features described herein. For example, the present disclosure contemplates articles having calibration instructions stored thereon, which when executed by a processor cause the processor to execute operations consistent with the present disclosure.

The methods and systems described herein are not limited to a particular hardware or software configuration, and may find applicability in many computing or processing environments. The methods and systems may be implemented in hardware or software, or a combination of hardware and software. The methods and systems may be implemented in one or more computer programs, where a computer program may be understood to include one or more processor executable instructions. The computer program(s) may execute on one or more programmable processors, and may be stored on one or more storage medium readable by the processor (including volatile and non-volatile memory and/or storage elements), one or more input devices, and/or one or more output devices. The processor thus may access one or more input devices to obtain input data, and may access one or more output devices to communicate output data. The input and/or output devices may include one or more of the following: Random Access Memory (RAM), Redundant Array of Independent Disks (RAID), floppy drive, CD, DVD, magnetic disk, internal hard drive, external hard drive, memory stick, flash memory, or other storage device capable of being accessed by a processor as provided herein, where such aforementioned examples are not exhaustive, and are for illustration and not limitation.

The computer program(s) may be implemented using one or more high level procedural or object-oriented programming languages to communicate with a computer system; however, the program(s) may be implemented in assembly or machine language, if desired. The language may be compiled or interpreted.

As provided herein, the processor(s) and/or processor circuit(s) may thus be embedded in one or more devices that may be operated independently or together in a networked environment, where the network may include, for example, a Local Area Network (LAN), wide area network (WAN), and/or may include an intranet and/or the internet and/or another network. The network(s) may be wired or wireless or a combination thereof and may use one or more communications protocols to facilitate communications between the different processors. The processors may be configured for distributed processing and may utilize, in some embodiments, a client-server model as needed. Accordingly, the methods and systems may utilize multiple processors and/or processor devices, and the processor instructions may be divided amongst such single- or multiple-processor/devices.

The device(s) or computer systems that integrate with the processor(s) may include, for example, a personal computer(s), workstation(s) (e.g., Sun, HP), personal digital assistant(s) (PDA(s)), handheld device(s) such as cellular telephone(s) or smart cellphone(s), laptop(s), handheld computer(s), or another device(s) capable of being integrated with a processor(s) that may operate as provided herein. Accordingly, the devices provided herein are not exhaustive and are provided for illustration and not limitation.

References to "a microprocessor" and "a processor", or "the microprocessor" and "the processor," may be understood to include one or more microprocessors that may communicate in a stand-alone and/or a distributed environment(s), and may thus be configured to communicate via wired or wireless communications with other processors, where such one or more processor may be configured to operate on one or more processor-controlled devices that may be similar or different devices. Use of such "microprocessor" or "processor" terminology may thus also be understood to include a central processing unit, an arithmetic logic unit, an application-specific integrated circuit (IC), and/or a task engine, with such examples provided for illustration and not limitation.

Furthermore, references to memory, unless otherwise specified, may include one or more processor-readable and accessible memory elements and/or components that may be internal to the processor-controlled device, external to the processor-controlled device, and/or may be accessed via a wired or wireless network using a variety of communications protocols, and unless otherwise specified, may be arranged to include a combination of external and internal memory devices, where such memory may be contiguous and/or partitioned based on the application. Accordingly, references to a database may be understood to include one or more memory associations, where such references may include commercially available database products (e.g., SQL, Informix, Oracle) and also proprietary databases, and may also include other structures for associating memory such as links, queues, graphs, trees, with such structures provided for illustration and not limitation.

References to a network, unless provided otherwise, may include one or more intranets and/or the internet. References herein to microprocessor instructions or microprocessor-executable instructions, in accordance with the above, may be understood to include programmable hardware.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A system, comprising:

a line status circuit configured to receive a line voltage and output a line status output representative of a first zero crossing $ZC_1$ of the line voltage;

a processor circuit configured to output at least one first relay control signal in response to a line status output;

a relay coupled to first, second and third line voltage inputs and configured to switch in response to the at least one first relay control signal, thereby coupling or decoupling the second and third line voltage inputs relative to a second zero crossing $ZC_2$ of the line voltage;

a relay status circuit configured to output a relay status output representative of a first switching of the relay in response to the at least one first relay control signal; and wherein the processor circuit is further configured to output at least one subsequent relay control signal, so as to trigger a subsequent switching of the relay, relative to at least one subsequent zero crossing $ZC_n$ of the line voltage, and wherein the subsequent switching occurs closer in time to the at least one zero crossing $ZC_n$ than the first switching occurs relative to the second zero crossing $ZC_2$.

2. The system of claim 1, further comprising:

a trigger circuit configured to output at least one first control pulse and at least one subsequent control pulse to the relay in response to the at least one first relay control signal and the at least one subsequent relay control signal, respectively;

wherein the relay switches in response to the at least one first control pulse and the at least one subsequent control pulse, respectively.

3. The system of claim 2, wherein the trigger circuit is a Schmitt trigger.

4. The system of claim 1, further comprising:

a power supply circuit operable to power the line status circuit, processor circuit, relay status circuit, and relay.

5. The system of claim 1, wherein the processor circuit is further configured to output the at least one first relay control signal after a known delay time D3, relative to the first zero crossing, calculate a calibrated delay from D4 and D3;

wherein D3 is a default delay time of a timer of the processor circuit, $D4=t_2-t_1$, and $t_1$ is a moment in time correlating to the second zero crossing $ZC_2$, and $t_2$ is a moment in time at which the processor circuit receives a relay status output representative of the first switching.

6. The system of claim 5, wherein the processor circuit is further configured to output the at least one subsequent relay control signal after the calibrated delay, relative to a zero crossing of the line voltage, such that the subsequent switching occurs closer in time to the at least one zero crossing $ZC_n$ than the first switching occurs relative to the second zero crossing $ZC_2$.

7. The system of claim 5, wherein the subsequent switching occurs at or substantially at the at least one zero crossing $ZC_n$.

8. A method, comprising:

outputting a line status output representative of a first zero crossing $ZC_1$ of a line voltage from a line status circuit;

outputting at least one first relay control signal from a processor circuit in response to the line status output after a known delay time D3, relative to the first zero crossing $ZC_1$;

first switching a relay in response to the first relay control signal, so as to couple and decouple second and third line voltage inputs with the relay, the relay further coupled to a first line voltage input, the first switching occurring relative to a second zero crossing $ZC_2$ of the line voltage;

outputting a relay status output representative of the first switching;

calculating an error D4 with the processor circuit, wherein the error D4 correlates to the time elapsing between a moment $t_1$ of the second zero crossing $ZC_2$ and a moment $t_2$ wherein the processor circuit receives the relay status output; and outputting at least one subsequent relay control signal from the processor circuit, so as to trigger a subsequent switching of the relay, relative to at least one subsequent zero crossing $ZC_n$ of the line voltage;

wherein the subsequent switching occurs closer in time to the at least one subsequent zero crossing $ZC_n$ than the first switching occurs relative to the second zero crossing $ZC_2$.

9. The method of claim 8, further comprising:

outputting a first control pulse and at least one subsequent control pulse from a trigger circuit in response to the at least one first relay control signal and the at least one subsequent relay control signal, respectively; and switching the relay in response to the at least one first control pulse and the at least one subsequent control pulse, respectively.

10. The method of claim 8, further comprising:

powering the line status circuit, the processor circuit, the relay status circuit, and the relay with a power supply circuit.

11. The method of claim 8, further comprising:

calculating with the processor circuit a calibrated delay from the error D4 and the known delay time D3.

12. The method of claim 11, further comprising:

outputting the at least one subsequent relay control signal from the processor circuit after the calibrated delay, relative to a zero crossing of the line voltage, such that the subsequent switching occurs closer in time to the at least one zero crossing $ZC_n$ than the first switching occurs relative to the second zero crossing $ZC_2$.

13. The method of claim 12, further comprising:

outputting the at least one subsequent relay control signal from the processor circuit after the calibrated delay, relative to a zero crossing of the line voltage, such that the subsequent switching occurs at or substantially at the at least one zero crossing $ZC_n$.

14. An article comprising a tangible storage medium having calibration instructions stored thereon, which when executed by a processor result in operations comprising:

outputting a line status output representative of a first zero crossing $ZC_1$ of a line voltage from a line status circuit;

outputting at least one first relay control signal from a processor circuit in response to the line status output after a known delay time D3, relative to the first zero crossing $ZC_1$;

first switching a relay in response to the first relay control signal, so as to couple and decouple second and third line voltage inputs with the relay, the relay further coupled to a first line voltage input, the first switching occurring relative to a second zero crossing $ZC_2$ of the line voltage;

outputting a relay status output representative of the first switching;

calculating an error D4 with the processor circuit, the error D4 correlating to the time elapsing between a moment $t_1$ of the second zero crossing $ZC_2$ and a moment $t_2$ wherein the processor circuit receives the relay status output; and outputting at least one subsequent relay control signal from the processor circuit signal so as to trigger a subsequent switching of the relay, relative to at least one subsequent zero crossing $ZC_n$ of the line voltage;

wherein the subsequent switching occurs closer in time to the at least one subsequent zero crossing $ZC_n$ than the first switching occurs relative to the second zero crossing $ZC_2$.

15. The article of claim 14, wherein the calibration instructions when executed by the processor result in additional operations comprising:

outputting a first control pulse and at least one subsequent control pulse from a trigger circuit in response to the at least one first relay control signal and the at least one subsequent relay control signal, respectively; and switching the relay in response to the at least one first control pulse and the at least one subsequent control pulse, respectively.

16. The article of claim 14, wherein the calibration instructions when executed by the processor result in additional operations comprising:

calculating with the processor circuit a calibrated delay from the error D4 and the known delay time D3.

17. The article of claim 16, wherein the calibration instructions when executed by the processor result in operations comprising:

outputting the at least one subsequent relay control signal from the processor circuit after the calibrated delay, relative to a zero crossing of the line voltage, such that the subsequent switching occurs closer in time to the at least one zero crossing $ZC_n$ than the first switching occurs relative to the second zero crossing $ZC_2$.

18. The article of claim 17, wherein the calibration instructions when executed by the processor result in operations comprising:

outputting the at least one subsequent relay control signal from the processor circuit after the calibrated delay, relative to a zero crossing of the line voltage, such that the subsequent switching occurs at or substantially at aid at least one zero crossing $ZC_n$.

* * * * *